United States Patent [19]

Magnes

[11] Patent Number: 4,592,098

[45] Date of Patent: Jun. 3, 1986

[54] LIQUID LEVEL CONTROL SYSTEM

[76] Inventor: Herbert Magnes, 2612 Obelisco Pl., Carlsbad, Calif. 92008

[21] Appl. No.: 732,705

[22] Filed: May 10, 1985

[51] Int. Cl.[4] ..... E04H 3/18

[52] U.S. Cl. ..... 4/508; 4/496; 4/507; 137/389; 137/400

[58] Field of Search ..... 4/508, 496, 507, 504; 137/389, 423, 432, 400, 410

[56] References Cited

U.S. PATENT DOCUMENTS

| | | | |
|---|---|---|---|
| 2,581,901 | 1/1952 | Biermann et al. | 137/423 X |
| 2,803,262 | 8/1957 | Shellenberger | 137/400 |
| 2,842,158 | 7/1958 | Robinson | 4/508 X |
| 3,040,769 | 6/1962 | Lamb | 137/423 X |
| 3,574,867 | 4/1971 | Biniores | 137/400 X |
| 3,727,243 | 4/1973 | Biniores | 137/423 X |
| 3,908,206 | 9/1975 | Grewing | 4/508 |

*Primary Examiner*—Henry K. Artis
*Attorney, Agent, or Firm*—Frank D. Gilliam

[57] ABSTRACT

The invention is directed to a liquid level control system which includes a primary float valve which allows liquid to flow into a pool reservoir when the level of fluid in the reservoir is below a first predetermined level and a secondary float valve associated with the primary flow valve which shuts off the flow of fluid into the pool reservoir when the level of liquid in the pool reservoir exceeds a second predetermined level which is higher in elevation than the first predetermined level. The primary valve continually operates between open and closed states. The secondary valve is normally in an open state and when it is caused to go to a closed state it remains closed until it is manually reset.

8 Claims, 7 Drawing Figures

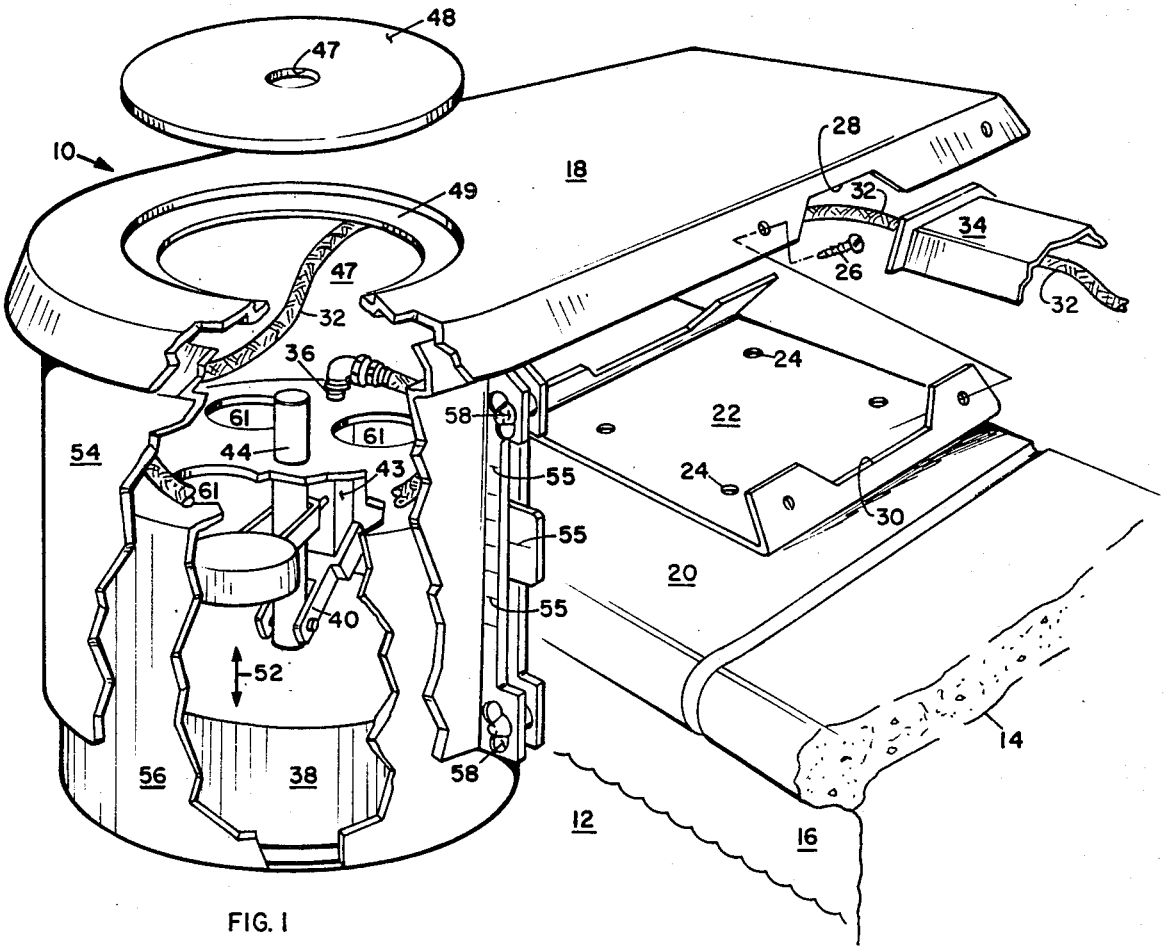
FIG. 1
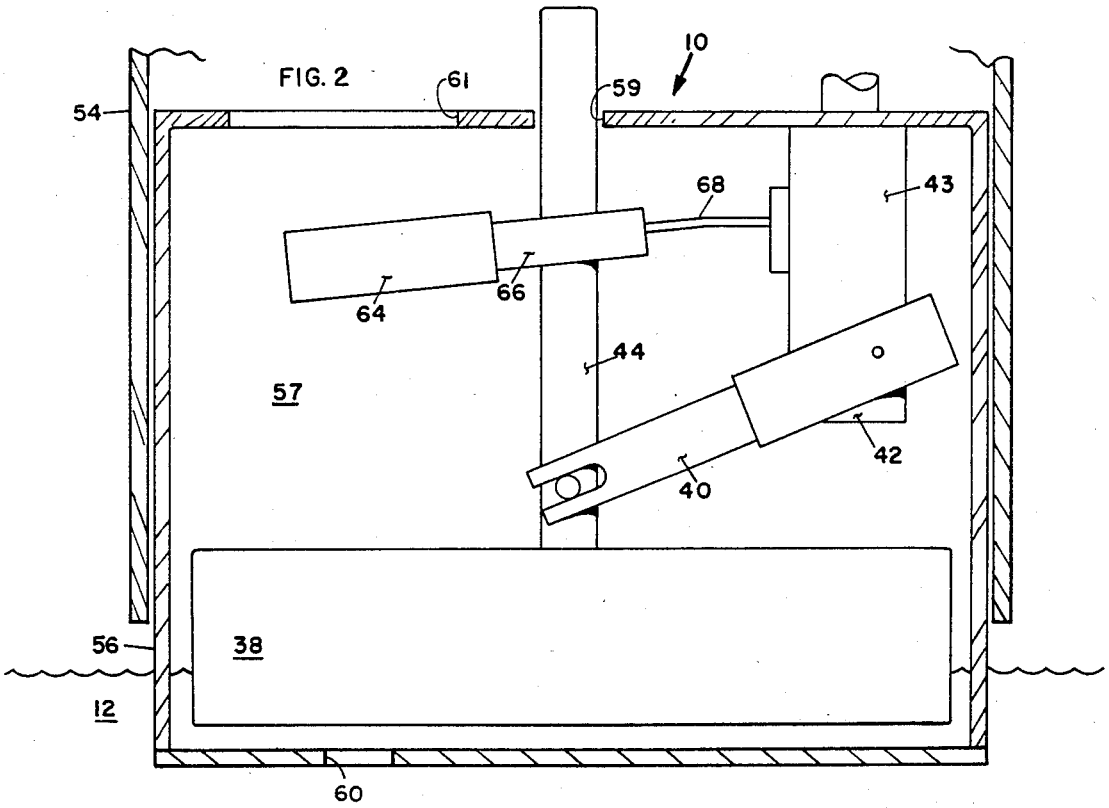

LIQUID LEVEL CONTROL SYSTEM

BACKGROUND OF THE INVENTION

This invention relates to liquid level control arts, and more particularly, to apparatus for maintaining the water level in a swimming pool or the like within predetermined maximum and minimum levels.

The water level within a swimming pool should be kept within a rather narrow range in order that the skimming portion of the recirculating and filter apparatus will function properly. This level is usually maintained by simply observing the water level and supplying makeup water from a line source with a manually operated valve. However, because the volume of water necessary to make up even a slightly lower level is considerable, the time necessary to bring the water to the desired level may be several hours, a circumstance which renders the task unpleasant and additionally, brings about the possibility of overfilling due to failure to monitor the progress of the operation carefully enough. Thus, it will be apparent that it would be highly advantageous to provide automatic means for maintaining the water level of swimming pools or like liquid reservoirs within predetermined maximum and minimum levels without the need for manual supervision or intervention which includes a fail safe back up system incorporated therein to prevent overfill if the automatic system fails while in the fill mode.

There are numerous automatic fill systems in the art directed to fill control of swimming pools and the like. These systems generally utilize float valve means to control the flow of new or additional water into the reservoir. These systems employ either mechanical or electrical valve control means responsive to float vertical positions. Although most of the prior art devices use a single liquid input control valve associated with a float, some prior art devices include a reservoir within valve means separating input and output conduits and includes a float actuated valve in both the input and output conduits whereby a single leaking valve will not cause overfilling of the swimming pool or reservoir.

U.S. Pat. No. 2,068,138 teaches a two stage float actuated valve system utilizing a pair of internal reservoirs each with a float and valve for controlling the flow of liquid into the reservoirs. One float and valve combination is the primary liquid flow control valve and the second acts as a backup in the event the primary valve fails to close off liquid flow into the reservoirs. Both valves are actuatable between open and closed states.

Obviously, in all the above prior art automatic fill valves a failure of one or both of the float valves will result in an overfill of the swimming pool or the like liquid reservoir.

Although some of the prior art devices are moderately successful in operation, none of the devices provide a fail safe lock on means for terminating the flow of liquid into a reservoir in the event of valving failure while in the fill mode.

SUMMARY OF THE INVENTION

The automatic valve system of the present invention includes a secondary or back up float activated valve positioned within the flow tube of the primary float valve. In the event of overfill of the pool or the like by a liquid passing through the primary float valve due to operation failure, the secondary or backup valve is activated from its normally biased open position to a closed position preventing liquid flow through the flow tube of the primary valve. The pressure from the liquid source, generally in the range of 20 to 110 pounds, holds the secondary or backup valve when in a closed state against the normal valve bias until the pressure is removed and the valve operated float is returned to a predetermined level.

The level control system is mounted on the side of the pool and extends into the pool water. The floats for the two valves are contained in a semi-enclosed chamber. The chamber is substantially enclosed to prevent surface water action from affecting the operation of the floats. At least one small aperture allows the pool liquid to enter the semi-enclosed chamber. The upper portion of the chamber is sufficiently vented to allow the water level therein to be equal to the normal surface level of the pool. A first valve, one end of which is connected to a source of liquid under pressure and the other end positioned over the surface of the pool, is operated by a first float which operates the first valve between an open state when the pool level is below a first predetermined level and a closed state when the first predetermined level is reached or exceeded. In the event that the first valve fails to achieve its closed state when the level reaches or exceeds the first predetermined level and the pool level increases to a second predetermined level, a level greater than the first predetermined level, the second or backup valve changes to its closed state terminating the flow through the inoperative first valve. The second valve includes a spring bias that holds the valve in an open state when the first valve operates in a normal expected fashion. The spring bias is overcome by the float when the pool level reaches the second predetermined valve and the valve is closed to liquid flow. Once closed, the valve remains closed by the pressure from the liquid source regardless of the position of its associated float. The secondary valve can be reset only with the water pressure removed and the pool water level below the second predetermined level.

An object of this invention is to provide a fail safe automatic fill system for a liquid reservoir.

Another object of the invention is to provide an automatic liquid reservoir fill system that terminates liquid flow into the reservoir in the event of control failure.

Still another object of the invention is to provide an automatic fill system for a liquid reservoir which must be manually reset when valve failure occurs and the flow of liquid to the reservoir is terminated.

Yet another object of the invention is to provide an automatic and fail safe liquid reservoir fill system which can be used on existing reservoirs the installation of which requires no modification to the reservoir.

Still other objects and advantages of the present invention will be appreciated from the details of construction and operation set forth in the accompanying specifications, claims and drawing figures.

BRIEF DESCRIPTION OF THE DRAWINGS

The features of the present invention which are believed to be novel are set forth with particularity in the appended claims. The invention, together with the further objects and advantages thereof may best be understood by reference to the following description, taken in conjunction with the accompanying drawings. In the drawings, like reference numerals identify like elements in the several Figures in which:

FIG. 1 is a perspective partial cut away and exploded showing of the automatic fill valve system of the present invention;

FIG. 2 is a schematic showing in cut-away of the floats and associated valves of the present invention;

DETAILED DESCRIPTION OF THE PREFERRED EMBODIMENT

Figure 4:
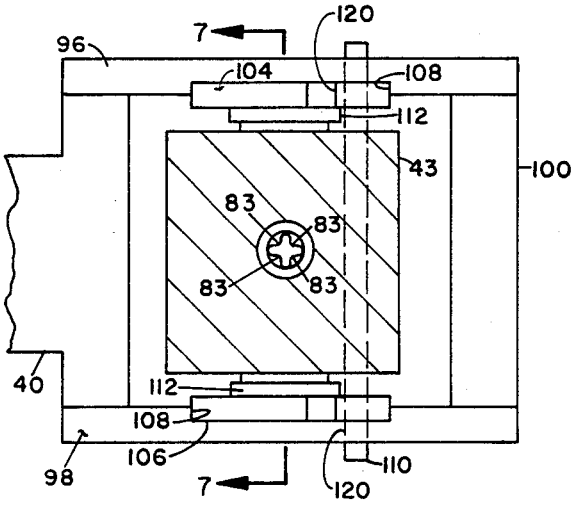
FIG. 4 is a showing taken along line 4—4 of FIG. 3.

In the illustrations given and with reference first to FIGS. 1 and 2 the numeral 10 designates generally a liquid level control system for use with a liquid reservoir or swimming pool 12 having a coping 14 around the edges 16 thereof. The liquid level control system 10 includes a pool mounting bracket 18 which attaches the device to the upper surface 20 of the coping by means of a pool attachment bracket 22. The bracket 22 is mounted to the pool by means of screws, adhesive or the like, four screws 24 shown. The bracket 18 attaches to bracket 22 by sheet metal screw means or the like 26. Cutouts 28 and 30 respectively of the brackets 18 and 22 allow for the securing of the protection shield 34 over the water hose 32. The hose 32 is attached to a pressurized supply, municipal or otherwise (not shown) and extends to a pressure sealed connection at the valve system inlet 36 by conventional and known means. The hose 32 is shown forming a loop partially around the upper surface of the valve chamber. This loop allows the chamber to translate up or down as hereinafter described without affecting the hose connection. The hose can also be connected to the valve via a pivotal mechanical connection, not shown.

The primary valve float 38 is attached to an actuating yoke 40 which operates a primary valve 42 located near the bottom of housing 43. The float is guided in its linear movement by means of an attached central and upward extending rod 44. A cover 48 for opening 47 in bracket 18 seats in lip 49 and prevents the entry of debris into the float chamber. The aperture 46 in the cover 48 allows for the displacement of air in or out of the chamber when the float 38 is translated along arrow 52.

The upper housing section 54 is joined to bracket 18 by any conventional attachment means such as adhesives or the like. A bottom housing section 56 is substantially enclosed to form a float chamber 57 which telescopically mates with the lower open end of upper housing section 54. The bottom housing section 56 is vertically adjustable relative to housing section 54 to accommodate different pool surface level to coping distances so that the floats that operate therein are properly located with respect to the pool liquid level. By the loosening of wing nuts 58, the bottom housing section, 56 can be height adjusted relative to the upper housing section 54. Markings 55 are provided for relative position adjustment reference. After a selected height adjustment the re-tightening of the wing nuts lock the relative positions of the housing sections. The bottom housing section 57 has at least one aperture 60 through its bottom surface to allow sufficient water to enter the float chamber 50 to maintain pool liquid level therein and yet small enough to prevent liquid surface movement from affecting the operation of the float 38. An upper surface opening 59 allows rod 44 to translate therein with float movement and openings 61 allow for venting.

A secondary valve 62 (see FIG. 3) is located within the chamber 43 and positioned in series between the valve 42 and liquid inlet 36. A float 64 (see FIG. 2) is attached to and operates valve 62 through a yoke 66 which embraces the rod 44 without contact therewith and an arm 68 which is attached to the yoke 66 and actuates the valve (as hereinafter discussed).

Figure 3:
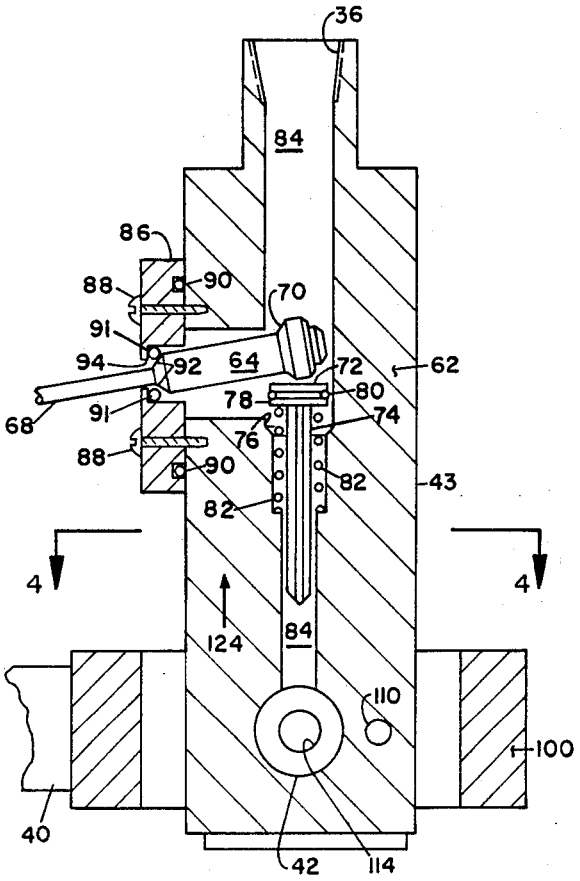
FIG. 3 is a partial cut-away showing of the mechanisms of the first and second valves of the invention.

Referring now specifically to FIG. 3, the valve housing 43, shown in cut-away, shows the secondary valve 62 and its operating mechanism. Float rod 68 is elevated from primary float yoke 40 as is float 64 in respect to float 38. The float rod 68 includes an enlarged end 64 supporting a bearing 70 constructed of lubricious material such as Teflon, brass or the like. The bearing 70 rides on the upper surface 72 of a valve plunger 74. The housing 43 further includes a valve seat 76 configured to receive head 78 of valve plunger 74 and form a sealing relationship with an "O" ring 80 carried by the head 78. When the float 64 is positioned above the water level in the bottom housing section 56, a coil spring 82 prevents the head 78 of the valve plunger 74 from nesting in the valve seat 76, thus allowing the liquid under pressure from hose 32 to pass around the valve plunger 74. The valve plunger 74 is shown having a cruciform cross-sectional configuration (see FIG. 4) with channels 83 which allow water flow through flow chamber 84 when valve 42 is in an open state (see FIG. 6). An end cap 86 held against housing 43 by means of screws 88 and sealed by "O" ring 90. The end cap 86 holds rod 68 and 70 in operable positions. An "O" ring 91 operably associated with the beveled surface 92 of the enlarged rod portion 69 prevents leakage of fluid through the rod aperture 94.

Figure 7:
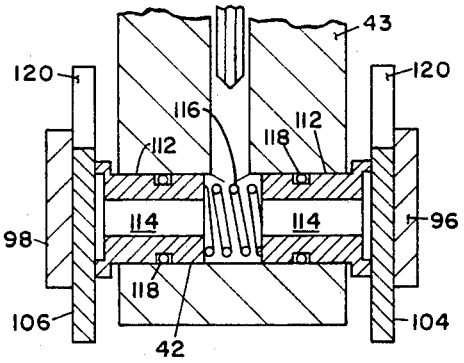
FIG. 7 is a showing of the first valve taken along line 7—7 of FIG. 4.

Referring now to FIGS. 4 and 7, the outer side extensions 96 and 98 of yoke 40 are connected together on parallel planes by means of the end of yoke 40 and spacer member 100 by means of cap screws 102 or the like. The sides 96 and 98 are connected to seal plates 104 and 106 by means of slots 108 and pin 110. The yoke is held in the position shown relative to the housing by pin 110 through the housing 43, end plates 86 and 96 and seal plates 104 and 106. A pair of shear seals 112 are inserted from each end of a transverse flow chamber 114. A coil spring 116 maintains outward pressure on the shear seals 112 forcing them against seal plates 104 and 106 where they remain in a captive sealed relationship. The seal plates and shear seals can be constructed of any suitable material that will establish a smooth rotary sealed engagement. Materials such as Teflon, bronze or the like may be used.

A pair of "O" ring seals 118 are carried around shear seals 112 to prevent liquid leak through the transverse flow chamber 114 between the shear seals. A slot 120 is formed in each seal plate 104 and 106. As hereinafter explained, the slot allows liquid flowing through the transverse flow chamber to exit the chamber when the valve is roatated downward about pin 110 toward the pool surface.

Figure 5:
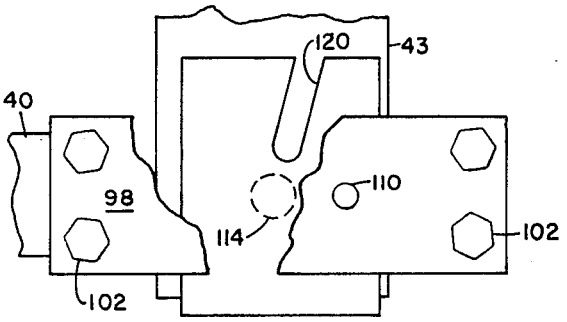
FIG. 5 is a partial cut-away showing of the operation of the first valve in its closed state.
Figure 6:
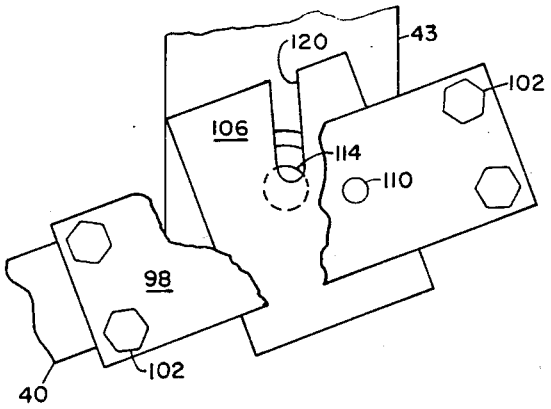
FIG. 6 is a partial cut-away showing of the operation of the first valve in its open state.

Referring now to FIGS. 5 and 6, FIG. 5 depicts the primary valve 42 in its closed position, i.e., the slots 120 are not aligned with transverse flow chamber 114 thus preventing liquid flow from chamber 84 through valve 42. FIG. 6 depicts the primary valve 42 in its open position, i.e., the slots 120 are now aligned with the transverse flow chamber 114 allowing liquid to flow out of the valve 42 through chamber 114.

It should be understood that the primary valve will continual pivot about pin 110 between its FIG. 5 and 6 positions depending on liquid level thereby maintaining the liquid level of the reservoir at a first predetermined level. The secondary valve 62 remains open and inoperative as long as the first valve functions in a normal expected manner.

If the expected operation of the primary valve 42 is prevented for any reason and the primary valve sticks or remains in an open condition allowing the liquid in the reservoir to reach a second pre-determined level the secondary valve 62 terminates the flow of liquid from source 32 into flow chamber 114. If valve 42 sticks open water from hose 32 will flow into the pool or reservoir allowing the water level in the bottom chamber to rise, causing float 64 to rise along arrow 52 whereby bearing 70 will depress valve the body 74 downward causing it to seat against the bias of spring 82. When the valve body is seated, the liquid pressure from hose 32 forces the valve body to remain seated even if the liquid level in the reservoir returns to or below its first predetermined level. With valve body 94 seated, liquid from hose 32 cannot now flow through the flow chambers 84 and 114 into the reservoir regardless of the position of slot 120 of the primary valve 42.

To re-initiate the flow of liquid through the control system, both the pressure now in the flow chamber 84 must be removed and the water level in the reservoir must be below actuation of float 64 so that the coil spring 82 can translate the valve body upward along arrow 124 whereby the valve body 74 is repositioned to its normally open state as shown in FIG. 3. The hose 32 can now be reconnected and the liquid under pressure again made available and allowing the control 10 to again monitor and control the level of liquid in the reservoir.

As should be understood, the automatic fluid control system is advantageous for maintaining reservoir fluid levels when unattended for long periods of time as the reservoir cannot be filled past the second predetermined level and valve problems, etc. will be readily noticeable and can be repaired prior to resetting and use.

It should be further understood that although the use and operation of the liquid level control system of the ignition is described herein for use with an existing reservoir or swimming pool, the device is not so limited. In new construction of swimming pools or the like the device of the invention can be used in a sump interconnected to the pool or reservoir in a manner to provide a liquid level equal to the swimming pool liquid level.

While in the foregoing specifications, a detailed description of the invention has been set forth for purposes of illustration, the details herein given may be varied by those skilled in the art without departing from the spirit and scope of the invention as defined by the appended claims.

What is claimed is:

1. A liquid level control system for use with a swimming pool or the like comprising:

a pool reservoir;

a source of liquid under pressure;

a first valve means connected between said source of liquid under pressure and said pool reservoir, said first valve means pivotly operable between open and closed states, said open state allows liquid to flow from said source of liquid under pressure into said pool reservoir and said closed state terminates said flow, the state of said valve is determined by a first predetermined level of liquid in said reservoir; and a second valve means connected in series with said source of liquid under pressure and said first valve means, said second valve means is operable only from a normally open to a biased closed state, said second valve changes from its normally open state to its biased closed state when a second predetermined level of liquid in said pool reservoir is exceeded.

2. The invention ad defined in claim 1 additionally comprising a housing partially submerged into the liquid in said pool reservoir, said housing encloses said first and second valve means.

3. The invention as defined in claim 2 wherein the submergible portion of said housing is adjustable to accommodate a range of selected first and second predetermined levels of liquid in said pool reservoir.

4. The invention as defined in claim 2 wherein said housing includes openings in its submerged portion so as to maintain substantially the same liquid level in said housing as in said pool reservoir.

5. The invention as defined in claim 1 wherein said first and second valve means are float operated.

6. The invention as defined in claim 1 wherein said first valve means comprises a central housing with an opening therethrough for the flow of liquid under pressure when said valve is open, a yoke having seal plates rotatable relative to said housing, a float connected to said yoke for varying the rotational position of said yoke responsive to the level of said liquid in said pool reservoir, said seal plate having an opening communicating with said opening in said housing when the level in said pool reservoir is less than said first predetermined level.

7. The invention as defined in claim 6 wherein said first valve further comprises shear seals biased against said yoke to seal off any flow of liquid under pressure when said level in said pool reservoir is at or greater than said first predetermined level.

8. The invention as defined in claim 1 wherein said second valve means comprises a float operated valve member and a valve seat positioned intermediate the source of fluid and said first valve means, a bias means for biasing said valve member away from said valve seat when said second valve is in an open state, whereby said liquid is allowed to flow around said valve member and into said first valve means, when the level of said pool reservoir exceeds said second predetermined level of liquid in said pool reservoir said float causes said valve member to contact said valve seat closing said second valve means, whereby the pressure of said liquid under pressure maintains said second valve means in its closed state.

* * * * *